US006207614B1

(12) United States Patent
Defieuw et al.

(10) Patent No.: US 6,207,614 B1
(45) Date of Patent: Mar. 27, 2001

(54) SUBSTANTIALLY LIGHT-INSENSITIVE BLACK AND WHITE MONOSHEET THERMOGRAPHIC RECORDING MATERIAL WITH IMPROVED IMAGE TONE

(75) Inventors: Geert Defieuw, Bonheiden; Johan Loccufier, Zwijnaarde; Armand Van-den Bergh, Wilrijk, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/477,892

(22) Filed: Jan. 5, 2000

Related U.S. Application Data

(60) Provisional application No. 60/114,816, filed on Jan. 6, 1999.

(51) Int. Cl.[7] ..... B41M 5/26

(52) U.S. Cl. ..... 503/201; 503/202; 503/212; 503/226

(58) Field of Search ..... 503/201, 202, 503/212, 226

(56) References Cited

FOREIGN PATENT DOCUMENTS 0 775 595 * 5/1997 (EP) .

* cited by examiner

*Primary Examiner*—Bruce H. Hess
(74) *Attorney, Agent, or Firm*—Baker Botts L.L.P.

(57) ABSTRACT

A substantially light-insensitive black and white monosheet thermographic recording material comprising a support and a thermosensitive element which is optionally provided with a protective layer, wherein the thermosensitive element contains substantially light-insensitive mixed crystals of at least one organic silver salt and at least one organic fatty acid derivative, an organic reducing agent for the organic silver salt in thermal working relationship therewith and a binder and wherein the substantially light-insensitive mixed crystals are present in an inner layer of the thermographic recording material; and a recording process therewith.

8 Claims, No Drawings

SUBSTANTIALLY LIGHT-INSENSITIVE BLACK AND WHITE MONOSHEET THERMOGRAPHIC RECORDING MATERIAL WITH IMPROVED IMAGE TONE

This application claims the benefit of U.S. Provisional Appln. No. 60/114,816 filed Jan. 6, 1999.

DESCRIPTION

1. Field of the invention

The present invention relates to thermographic recording materials whose prints have improved image tone.

2. Background of the invention

Thermal imaging or thermography is a recording process wherein images are generated by the use of thermal energy. In direct thermal thermography a visible image pattern is formed by image-wise heating of a recording material containing matter that by chemical or physical process changes colour or optical density. Most of the "direct" thermographic recording materials are of the chemical type. On heating to a certain conversion temperature, an irreversible chemical reaction takes place and a coloured image is produced.

According to U.S. Pat. No. 3,080,254 a typical heat-sensitive (thermographic) copy paper includes in the heat-sensitive layer a thermoplastic binder, a water-insoluble silver salt and an appropriate organic reducing agent.

EP 669 876 discloses a recording material comprising on a support (i) a heat sensitive layer comprising a substantially light insensitive organic silver salt, (ii) a protective layer containing a thermomeltable particle dispersed in a binder and (iii) a reducing agent being present in the heat sensitive layer and/or any other layer of the recording material on the same side of the support carrying the heat sensitive layer. According to EP 669 876, the thermomeltable particles are waxes such as e.g. amide waxes, bees wax, polyethylene wax, polytetrafluoroethylene wax, Carnauba wax etc.

EP-A 775 595 discloses a recording material comprising at least one thermosensitive element, comprising a substantially light-insensitive organic silver salt and an organic reducing agent therefor in thermal working relationship therewith, on a support, characterized in that an outermost layer of the recording material comprises at least one solid lubricant having a melting point below 150° C. and at least one liquid lubricant in a binder, wherein at least one of the lubricants is a phosphoric acid derivative. Solid lubricants which can be used according to EP-A 775 595 include ester waxes e.g. fatty acid esters, and amide waxes e.g. fatty acid amides.

EP 669 876 and EP-A 775 595 concern the use of waxes in the protective layers of thermographic materials which overcoat a layer containing organic silver salts i.e. the waxes and organic silver salts are not in the same layer.

Prior art substantially light-insensitive black and white thermographic recording materials exhibit an insufficiently neutral image colour due to the thermal development process in which temperatures up to 300 to 400° C. are reached for a heating time which may be less than a 1.0 ms. However, image tone is particularly important for thermographic recording materials for medical diagnostic applications for which image tone requirements are particularly severe, particularly at low optical densities. There is therefore a need for thermographic materials which produce more neutral image tones upon image-wise thermal development.

OBJECTS OF THE INVENTION

It is therefore an object of the present invention to provide substantially light-insensitive black and white thermographic recording materials whose prints exhibit a more neutral image tone.

Further objects and advantages of the invention will become apparent from the description hereinafter.

SUMMARY OF THE INVENTION

Surprisingly it has been found that substantially light-insensitive black and white monosheet thermographic recording materials with a thermosensitive element containing substantially light-insensitive mixed crystals of at least one organic silver salt and at least one organic fatty acid derivative in an inner layer exhibit a more neutral image tone than thermographic recording materials with crystals of a substantially light-insensitive organic silver salt.

The above mentioned objects are realized by a substantially light-insensitive black and white monosheet thermographic recording material comprising a support and a thermosensitive element which is optionally provided with a protective layer, wherein the thermosensitive element contains substantially light-insensitive mixed crystals of at least one organic silver salt and at least one organic fatty acid derivative, an organic reducing agent for the organic silver salt in thermal working relationship therewith and a binder and wherein the substantially light-insensitive mixed crystals are present in an inner layer of the thermographic recording material.

A recording process is further provided according to the present invention comprising the steps of: (i) bringing an outermost layer of the above-mentioned thermographic recording material in proximity with a heat source; and (ii) applying heat from the heat source imagewise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

DEFINITIONS

By substantially light-insensitive is meant not intentionally light sensitive.

An inner layer is a layer which is not the outermost layer of a material.

A mixed crystal is a mixture of at least two species in which only a single species can be detected by an X-ray diffractometer (XRD), which may be one of the components with slightly shifted XRD-lines reflecting the take-up of one of the components in the crystal lattice of the other.

A fatty acid is an organic monobasic acid of the general formula $C_nH_{2n+1}COOH$ derived from the saturated series of aliphatic hydrocarbons e.g. arachidic acid, behenic acid, stearic acid, palmitic acid and myristic acid, but also includes unsaturated hydrocarbon groups as in the case of erucic acid, oleic acid, linoleic acid, elaidic acid, vaccenic acid and arachidonic acid.

Tallow is animal fat containing as glycerides oleic acid, palmitic acid, stearic acid, myristic acid, linoleic acid and small quantities of cholesterol, arachidonic, elaidic and vaccenic acids and has a solidification point which ranges from 40 to 46° C.

Organic Fatty Acid Derivatives

The term organic fatty acid derivatives as used herein refers to derivatives of one or more saturated or unsaturated fatty acids such as esters, amides etc. or mixtures thereof, which do not contain metallic atoms. The term does not include fatty acids. Preferred organic fatty acid derivatives are ester and amide waxes or mixtures thereof. The esters may have one or more ester groups depending on whether the alcohols forming the esters have one or more esterifiable hydroxy groups in addition to other functional groups. Examples of alcohols with more than one esterifiable hydroxy group are glycerine, sorbitan etc. Examples of ester and amide waxes suitable for use in the substantially light-insensitive thermographic recording materials of the present invention are:

WAX01: glycerine tristearate;

WAX02: glycerine monostearate;

WAX03: methyl stearate;

WAX04: N-(2-hydroxy-1-propyl)-lauramide, $C_{11}H_{23}CONHCH_2CHOHCH_3$;

WAX05: glycerine monopalmitate;

WAX06: oleamide;

WAX07: erucamide;

WAX08: glycerine monotallow acid ester; (RILANIT™ GMS from HENKEL AG);

WAX09: sorbitan monostearate (SPAN™ 60 from ICI PLC);

WAX10: sorbitan tristearate (SPAN™ 65 from ICI PLC);

WAX11: sorbitan monopalmitate (SPAN™ 40 from ICI PLC);

WAX12: POE-(4)-sorbitan monostearate (TWEEN™ 61 from ICI).

Preferred ester- or amide-waxes for use in the present invention are selected from the group consisting of: glycerine tristearate, glycerine monostearate and N-(2-hydroxy-1-propyl)-lauramide.

Substantially Light-Insensitive Mixed Crystals of Organic Silver Salts with Organic Fatty Acid Derivatives Substantially light-insensitive mixed crystals of at least one organic silver salts with at least one organic fatty acid derivative exhibit the X-ray diffraction pattern of the organic silver salt, although the peaks may be slightly shifted compared with the X-ray diffraction spectrum of pure crystals of the organic silver salt.

It is preferred that at least one of the at least one organic silver salts is a silver salt of an organic carboxylic acid, with a silver salt of an aliphatic monocarboxylic acid with at least 12 carbon atoms, e.g. silver laurate, silver palmitate, silver stearate, silver hydroxystearate, silver behenate, silver arachidate and silver salts of modified aliphatic carboxylic acids with thioether group as described e.g. in GB-P 1,111,492, being particularly preferred. Especially preferred silver salts of aliphatic monocarboxylic acids are selected from the group consisting silver stearate, silver arachidate and silver behenate.

The mixed crystals may be prepared by standard techniques in which the organic fatty acid derivative is incorporated into the lattice of the organic silver salt during the formation or precipitation thereof.

Substantially Light-Insensitive Organic Silver Salt Dispersions

The mixed crystals used according to the present invention may be dispersed by standard dispersion techniques. Ball mills, bead mills, microfluidizers, ultrasonic apparatuses, rotor stator mixers etc. have been found to be useful in this regard.

Thermosensitive Element

The thermosensitive element, according to the present invention, comprises substantially light-insensitive mixed crystals of at least one organic silver salt and at least one organic fatty acid derivative, an organic reducing agent for the organic silver salt in thermal working relationship therewith and a binder. The element may comprise a layer system in which the ingredients may be dispersed in different layers, with the proviso that the two ingredients are in reactive association with one another i.e. during the thermal development process the reducing agent must be present in such a way that it is able to diffuse to the mixed crystals so that reduction of the at least one organic silver salt to silver can take place and the proviso that should the mixed crystals are in an inner layer of the thermographic element i.e. if thermosensitive element is not provided with a protective layer the mixed crystals are not present in the outermost layer of the thermosensitive element.

Reducing Agents

Suitable organic reducing agents for the reduction of the at least one organic silver salt are organic compounds containing at least one active hydrogen atom linked to O, N or C, such as is the case with, aromatic di- and tri-hydroxy compounds; aminophenols; METOL (tradename); p-phenylene-diamines; alkoxynaphthols, e.g. 4-methoxy-1-naphthol described in U.S. Pat. No. 3,094,417; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Catechol-type reducing agents, i.e. reducing agents containing at least one benzene nucleus with two hydroxy groups (-OH) in ortho-position, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-B 692 733 and unpublished European Patent Application EP 97202872.4 being particularly preferred.

Combinations of reducing agents may also be used that on heating become reactive partners in the reduction of the substantially light-insensitive organic silver salt containing mixed crystals of at least one organic silver salt and at least one organic fatty acid derivative. For example, combinations of reducing agents with sulfonamidophenols are described in the periodical Research Disclosure, February 1979, item 17842, in U.S. Pat. Nos. 4,360,581 and 4,782,004, and in EP-A 423 891. Combinations of sterically hindered phenols with sulfonyl hydrazide reducing agents are disclosed in U.S. Pat. No. 5,464,738; with trityl hydrazides and formyl-phenyl-hydrazides in U.S. Pat. No. 5,496,695; with trityl hydrazides and formyl-phenyl-hydrazides together with diverse auxiliary reducing agents in U.S. Pat. No. 5,545,505, U.S. Pat. No. 5.545.507 and U.S. Pat. No. 5,558,983; with acrylonitrile compounds in U.S. Pat. No. 5,545,515 and U.S. Pat. No. 5,635,339; and with 2-substituted malonodialdehyde compounds in U.S. Pat. No. 5,654,130. Sterically hindered phenols and bisphenols have also been used in such reducing agent combinations, as disclosed in U.S. Pat. No. 4,001,026 and U.S. Pat. No. 3,547,648 respectively.

Film-Forming Binders of the Thermosensitive Element

The film-forming binder of the thermosensitive element containing mixed crystals of at least one organic silver salt and at least one organic fatty acid derivative may be all kinds of natural, modified natural or synthetic resins or mixtures of such resins, in which the mixed crystals of at least one organic silver salt and at least one organic fatty acid derivative can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The binder to organic silver salt weight ratio is preferably in the range of 0.2 to 6, and the thickness of the thermosensitive element is preferably in the range of 5 to 50 μm.

Toning Agent

In order to obtain a neutral black image tone in the higher densities and neutral grey in the lower densities, the thermosensitive element preferably further contains a so-called toning agent.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. No. 3,951,660 and U.S. Pat. No. 5,599,647.

Stabilisers and Antifoggants

In order to obtain improved shelf-life and reduced fogging, stabilizers and antifoggants may be incorporated into the thermographic recording materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589 and in the references cited in all these documents.

Polycarboxylic Acids and Anhydrides Thereof

According to the recording material of the present invention the thermosensitive element preferably further contains at least one polycarboxylic acid and/or anhydride thereof in a molar percentage of at least 10 with respect to all the organic silver salt(s) present and in thermal working relationship therewith, with a molar percentage of at least 15 with respect to all the organic silver salt(s) being particularly preferred. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g. : succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are: maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILONE™ Öl MA (from BAYER AG, GERMANY), ultraviolet light absorbing compounds, white light reflecting and/or ultraviolet radiation reflecting pigments and/or optical brightening agents.

Support

The support for the thermosensitive element according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate.

The support may be in sheet, ribbon or web form and subbed if need be to improve the adherence to the thereon coated thermosensitive element. The support may be made of an opacified resin composition, e.g. polyethylene terephthalate opacified by means of pigments and/or micro-voids and/or coated with an opaque pigment-binder layer, and may be called synthetic paper, or paperlike film. Should a transparent base be used, the base may be colourless or coloured, e.g. having a blue colour. One or more backing layers may be provided to control physical properties such as curl and static.

Protective Layer

According to a preferred embodiment of the recording material, according to the present invention, the thermosensitive element is provided with a protective layer to avoid local deformation of the thermosensitive element and to improve resistance to abrasion.

The protective layer contains a binder, which may be solvent-soluble, solvent-dispersible, water-soluble or water-dispersible. Among the solvent-soluble binders polycarbonates as described in EP-A 614 769 is particularly preferred. However, water-soluble or water-dispersible binders are preferred for the protective layer e.g. gelatin, polyvinylalcohol, cellulose derivatives or other polysaccharides, hydroxyethyl-cellulose, hydroxypropylcellulose etc., with hardenable binders being preferred and polyvinylalcohol being particularly preferred, as coating can be performed from an aqueous composition and mixing of the protective layer with the immediate underlayer can be avoided by using a solvent-soluble or solvent-dispersible binder in the immediate underlayer.

The protective layer according to the present invention may be crosslinked by using crosslinking agents such as described in WO 95/12495 e.g. tetra-alkoxysilanes, polyisocyanates, zirconates, titanates, melamine resins etc.

A protective layer according to the present invention may additionally comprise solid or liquid lubricants or combinations to improve the slip characteristics of the thermographic recording materials e.g. thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

The protective layer of the recording material according to the present invention may also comprise a matting agent. Suitable matting agents, which optionally protrude from the outermost layer, are described in WO 94/11198 and include e.g. talc particles.

Antihalation Dyes

In addition to the ingredients, the thermographic recording materials used in the present invention may also contain antihalation or acutance dyes which absorb infra-red light, for absorption by a dye which converts the absorbed infra-red light into heat, which has passed through the thermosensitive element thereby preventing its reflection

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd—YAG laser or other infra-red laser, with a thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. Such thermal printing heads may be used in contact or close proximity with the recording material. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. The image-wise heating can be carried out such that heating elements not required to produce an image pixel generate an amount of heat ($H_e$) in accordance with the following formula: $0.5\ H_D<H_e<H_D$ wherein $H_D$ represents the minimum amount of heat required to cause visible image formation in the recording material.

EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound, using e.g. an ultrasonic pixel printer as described e.g. in U.S. Pat. No. 4,908,631.

Industrial Application

Thermographic imaging can be used for the production of transparencies and reflection type prints. Application of the present invention is envisaged in the fields of both graphics images requiring high contrast images with a very steep dependence of print density upon applied dot energy and continuous tone images requiring a weaker dependence of print density upon applied dot energy, such as required in the medical diagnostic field. In the hard copy field thermographic recording materials on a white opaque base are used, whereas in the medical diagnostic field black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

AgB=silver behenate;

B79=BUTVAR™ B79, a polyvinyl butyral from MONSANTO, as binder;

R01=ethyl 3,4-dihydroxybenzoate, as reducing agent;

the toning agents:

T01=7-(ethylcarbonato)-benzo[e][ 1,3]oxazine-2,4-dione;

T02=benzo[e] [1,3]oxazine-2,4-dione; and the silicone oil:

BAYSILON™ MA, a polydimethylsiloxane from BAYER.

Preparation of Mixed Crystal Types I to V & Silver Behenate Type VI 0.75 mol of behenic acid and the appropriate amount of the organic fatty acid derivative, where appropriate, (see table 1 for quantity) was added to ca. 750mL of 2-butanone in a 5 L vessel and the dispersion heated with stirring at 500 rpm to 70° C. giving a clear solution. Ca. 1 L of 0.75 M aqueous sodium hydroxide was added slowly until a pH of ca. 9.9 was attained then after 5 minutes further stirring ca. 0.92 L of 0.75 M aqueous silver nitrate was added at a constant rate over a period of 240 minutes until a UAg (defined as the potential difference between a silver electrode of ≧99.99% purity in the aqueous liquid and a reference electrode consisting of a Ag/AgCl-electrode in 3 M KCl solution at room temperature connected with the aqueous liquid via a salt bridge consisting of a 10% $KNO_3$ salt solution) of approximately 330 mV was attained, thereby producing a ca. 12% dispersion of organic silver salt. The organic silver salt was then filtered off and washed four times with deionized water with 2% of 2-propanol, after which it was dried for 60 hours at 45° C.

TABLE 1

| | Organic fatty acid derivative | | | volume | | |
|---|---|---|---|---|---|---|
| | | | | | 0.8M $AgNO_3$ | |
| Mixed crystal type | type | % by weight versus AgB | quantity of 2-butanone [mL] | of 0.75M NaOH added [mL] | volume added [mL] | addition time [min] |
| I | WAX01 | 10 | 750 | 1019 | 938 | 240 |
| II | WAX02 | 10 | 750 | 995 | 913 | 240 |
| III | WAX03 | 10 | 750 | 950 | 914 | 240 |
| IV | WAX04 | 10 | 750 | 1012 | 919 | 240 |
| V | WAX04 | 25 | 750 | 993 | 927 | 240 |
| VI | — | — | 750 | 994 | 922 | 240 |

X-ray diffraction spectra were then obtained for the dried organic silver salts of types I to VI with an X-ray diffractometer using a $CuK_\alpha$ X-ray source at a current of 30 mA and an energy of 40 kV in the Bragg angle 2Θ range 1.5 to 55° with a step-size of 0.05° and a step-time of 1 s. The XRD-spectra obtained all corresponded to the reference spectrum of the Joint Committee on Powder Diffraction Standards (JCPDS) Powder Diffraction File for AgB: 4–48, published by the International Center for Diffraction Data, 12 Campus Boulevard, Newtown Square, Pa. 19073-3273 U.S.A. Qualifying remarks for the different organic silver salt types are given in table 2 below.

The morphology of the particles was also evaluated by scanning electron microscopy. The powder was mounted in an aluminium holder with double-sided tape and then a gold layer was sputtered thereon. The results are summarized in Table 2.

TABLE 2

| | organic fatty acid derivative | | | |
|---|---|---|---|---|
| Mixed crystal type | type | % by weight versus AgB | Morphology of particles | XRD-spectra in comparison with the reference spectrum for AgB (JCPDS# 4–48) |
| I | WAX01 | 10 | needles & platelets | AgB-peaks shifted to slightly larger angles, no extra peaks |
| II | WAX02 | 10 | needles & platelets | AgB-peaks shifted to slightly larger angles, no extra peaks |
| III | WAX03 | 10 | needles & platelets | first 4 AgB-peaks shifted to slightly larger angles, no extra peaks |
| IV | WAX04 | 10 | needles | AgB-peaks shifted to slightly larger angles, no extra peaks |
| V | WAX04 | 25 | needles | Same spectrum as for type VI, no extra peaks |
| VI | — | — | needles | extra signals at 2Θ = 20.8° & 32.4° |

#Joint Committee on Powder Diffraction Standards

These XRD-spectra clearly demonstrate the presence of mixed crystals in the case of organic silver salt types I to V and the SEM-photo's show an influence of the organic fatty acid derivative upon the morphology of the particles of organic silver salt.

INVENTION EXAMPLES 1 to 5 and COMPARATIVE EXAMPLE 1

Preparation of Organic Silver Salt Dispersions 10 g of organic silver salt (for composition see table 2) was mixed with 2.5 g of a 30% solution of B79 in 2-butanone and 737.5 g of 2-butanone for 72 hours in a ball mill. 30.83 g of a 30% solution of B79 in 2-butanone and 7.67 g of 2-butanone were then added to the resulting dispersion and the mixture ball milled for a further 60 minutes.

Preparation of Coating Dispersions 40 g of the organic silver salt dispersion was mixed with 29.86 g of a 30% solution of B79, 0.90 g of a 2-butanone dispersion containing 4.13% of B79, 14.01% of T01 and 25.86% of T02, 0.40 g of BAYSILON™ MA and 0.323 g of adipic acid and 15 g of 2-butanone to a homogeneous dispersion. 1.844 g of R01, 0.288 g of tetrachloro-phthalic anhydride, 0.24 g of benzotriazole and 17.08 g of 2-butanone were then mixed separately and 9.59 g thereof was added to the homogenized organic silver salt dispersion prior to doctor blade coating. Doctor blade coating onto a 175 μm thick subbed polyethylene terephthalate support was carried out with the blade adjusted to 170 μn. The resulting layers were dried for 1 hour at 50° C. to produce the thermosensitive elements of the thermographic recording materials of INVENTION EXAMPLES and COMPARA- TIVE EXAMPLE 1 produced with type I to V mixed crystals and the silver behenate reference, type VI, respectively. After drying the thermographic recording materials of INVENTION EXAMPLES 1 to 5 and COMPARATIVE EXAMPLE 1 were subjected to 7 days conditioning at 45° C. and 70% relative humidity to produce "fresh materials" for printing.

Thermographic Printing

During the thermographic printing of the thermographic recording materials of INVENTION EXAMPLES 1 to 5 and COMPARATIVE EXAMPLE 1, the print head was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$m.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of INVENTION EXAMPLES 1 to 5 and COMPARATIVE EXAMPLE 1.

The maximum densities, $D_{max}$, and minimum densities, $D_{min}$, of the prints given in table 3 were measured through visible or blue filters with a MACBETH™ TR924 densitometer in the grey scale step corresponding to data levels of 64 and 0 respectively and the $D_{max}$-values are given in table 3 for INVENTION EXAMPLE 1 to 5 and COMPARATIVE EXAMPLE 1 together with the change in $D_{max}$-values upon subjecting the "fresh materials" to 7 days conditioning at 45° C. and 70% relative humidity (RH).

Image Evaluation

The image tone of fresh prints made with the thermographic recording materials of INVENTION EXAMPLES 1 to 5 and COMPARATIVE EXAMPLE 1 were assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the thermographic recording materials of INVENTION EXAMPLES 1 to 5 and COMPARATIVE EXAMPLE 1 at optical densities, D, of 1.0 are summarized in table 3.

TABLE 3

| | Organic silver salt type | AgB coverage [g/m$^2$] | fresh material $D_{max}$ (blue) | $\Delta D_{max}$ (blue) after 7 d at 45° C./ 70% RH | CIELAB at D = 1.0 a* | CIELAB at D = 1.0 b* |
|---|---|---|---|---|---|---|
| Invention example number | | | | | | |
| 1 | I | 3.92 | 3.15 | −0.05 | −2.5 | 2.6 |
| 2 | II | 3.92 | 3.24 | −0.04 | −2.2 | 2.8 |
| 3 | III | 3.92 | 3.33 | −0.03 | −2.4 | 3.4 |
| 4 | IV | 3.92 | 3.37 | −0.07 | −2.3 | 3.6 |
| 5 | V | 3.45 | 3.25 | +0.05 | −2.2 | 1.1 |
| Comparative example number | | | | | | |
| 1 | VI | 4.32 | 3.52 | +0.08 | −2.4 | 4 |

In terms of the visual perception of an image as a whole, the image tone of elements of the image with a density of 1.0 have a stronger effect than the image tone of elements with lower or higher optical densities. Furthermore, the image tone generally becomes more neutral as the density increases. The CIELAB co-ordinates for an optical density of 1.0 are therefore critical in assessing the perceived image tone of an image.

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming more yellow as b* becomes more positive.

In table 2, at least one of the CIELAB-values corresponding to an optical density of 1.0 for prints with the thermographic recording materials of INVENTION EXAMPLES 1 to 5 is significantly lower than the corresponding value for the reference thermographic recording material of COMPARATIVE EXAMPLE 1. Prints with the thermographic recording materials of INVENTION EXAMPLES 1 and 5 with mixed crystals of organic silver salts of types I, II and V consisting of silver behenate with 10% by weight of glycerine tristearate, 10% by weight of glycerine monostearate and 25% by weight of N-[2-hydroxy-1-propyl]-lauramide respectively exhibited significantly improved tone neutrality.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white monosheet thermographic recording material comprising a support and a thermosensitive element which is optionally provided with a protective layer, wherein said thermosensitive element contains substantially light-insensitive mixed crystals of at least one organic silver salt and at least one organic fatty acid derivative, an organic reducing agent for said organic silver salt in thermal working relationship therewith and a binder and wherein said substantially light-insensitive mixed crystals are present in an inner layer of said thermographic recording material.

2. Thermographic recording material according to claim 1, wherein at least one of said at least one organic silver salts is a silver salt of an organic carboxylic acid.

3. Thermographic recording material according to claim 2, wherein said silver salt of an organic carboxylic acid is an aliphatic monocarboxylic acid with at least 12 carbon atoms.

4. Thermographic recording material according to claim 3, wherein said silver salt of an aliphatic monocarboxylic acid is selected from the group consisting of silver stearate, silver arachidate and silver behenate.

5. Thermographic recording material according to claim 1, wherein at least one of said at least one organic fatty acid derivatives is an ester- or an amide-wax.

6. Thermographic recording material according to claim 5, wherein said ester- or amide-wax is selected from the group consisting of: glycerine tristearate, glycerine monostearate and N-(2-hydroxy-1-propyl)-lauramide.

7. A recording process comprising the steps of: (i) bringing an outermost layer of a thermographic recording material having a support and a thermosensitive element which is optionally provided with a protective layer into proximity with a heat source, said thermosensitive element containing substantially light-insensitive mixed crystals of at least one organic silver salt and at least one organic fatty acid derivative, an organic reducing agent for said organic silver salt in thermal working relationship therewith and a binder and said substantially light-insensitive mixed crystals are present in an inner layer of said thermographic recording material; (ii) applying heat from said heat source imagewise to said thermographic recording material while maintaining proximity to said heat source to produce an image; and (iii) removing said thermographic recording material from said heat source.

8. Recording process according to claim 7, wherein said heat source is a thin film thermal head.

* * * * *